US010060119B2

(12) United States Patent
Bosman et al.

(10) Patent No.: US 10,060,119 B2
(45) Date of Patent: Aug. 28, 2018

(54) STRUCTURES HAVING AT LEAST ONE POLYMERIC FIBER TENSION ELEMENT

(71) Applicant: DSM IP ASSETS B.V., Heerlen (NL)

(72) Inventors: Rigobert Bosman, Echt (NL); Tom Antonius Philomena Engels, Echt (NL); Martin Pieter Vlasblom, Echt (NL); Roelof Marissen, Echt (NL); Benjamin B. Ackers, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 0 days.

(21) Appl. No.: 15/322,600

(22) PCT Filed: Jun. 29, 2015

(86) PCT No.: PCT/EP2015/064726
§ 371 (c)(1),
(2) Date: Dec. 28, 2016

(87) PCT Pub. No.: WO2016/001158
PCT Pub. Date: Jan. 7, 2016

(65) Prior Publication Data

US 2017/0130446 A1 May 11, 2017

(30) Foreign Application Priority Data

Jul. 1, 2014 (EP) ..... 14175156

(51) Int. Cl.
*E04C 1/00* (2006.01)
*E04B 1/28* (2006.01)
(Continued)

(52) U.S. Cl.
CPC ..... *E04B 1/28* (2013.01); *D01F 6/04* (2013.01); *E04B 1/19* (2013.01); *B63B 2021/505* (2013.01); *E04B 2001/1996* (2013.01)

(58) Field of Classification Search
CPC ..... E04B 1/344; E04B 1/3442; E04B 2001/1933; E04B 2001/1924;
(Continued)

(56) References Cited

U.S. PATENT DOCUMENTS 3,913,105 A * 10/1975 Williamson ..... E04L 31/34326 343/840
4,384,016 A 5/1983 Ide et al.
(Continued)

FOREIGN PATENT DOCUMENTS

DE 10 2008 005051 7/2009
EP 0 200 547 11/1986
(Continued)

OTHER PUBLICATIONS

International Search Report for PCT/EP2015/064726, dated Sep. 22, 2015, 2 pages.
(Continued)

*Primary Examiner* — Chi Q Nguyen
(74) *Attorney, Agent, or Firm* — Nixon & Vanderhye P.C.

(57) ABSTRACT

Structures are provided with rigid elements connected together by interconnecting elements in such a way to form a statically determined or statically over-determined structure. The structure includes at least one tension element formed of polymeric fibers having a stabilizing creep of at least 0.3% and at most 10% and a minimum creep rate lower than $1\times10^{-5}$% per second, wherein the said stabilizing creep and minimum creep are measured at a tension of 900 MPa and a temperature of 30° C. The structures may include, for example, framing structures (e.g., a space frame), suspended bodies, platforms, (e.g., a marine platform), or spoked wheels.

15 Claims, 5 Drawing Sheets

(51) Int. Cl.
*D01F 6/04* (2006.01)
*E04B 1/19* (2006.01)
*B63B 21/50* (2006.01)

(58) Field of Classification Search
CPC ..... E04B 2001/1921; E04B 1/28; E04B 1/19; E04B 2001/2696; E04B 1/30; E04B 2001/1996; B63B 2021/505; B63B 21/502; E21B 33/038; E21B 19/004
USPC ..... 52/646, 647, 651.02, 651.01; 166/350, 166/367
See application file for complete search history.

(56) References Cited

U.S. PATENT DOCUMENTS

| | | | | |
|---|---|---|---|---|
| 4,413,110 | A | 11/1983 | Kavesh et al. | |
| 4,745,725 | A * | 5/1988 | Onoda | B64G 9/00 52/646 |
| 4,771,585 | A * | 9/1988 | Onoda | B64G 9/00 52/111 |
| 5,014,484 | A * | 5/1991 | Tanizawa | E04L 31/19 52/645 |
| 5,125,206 | A | 6/1992 | Motohashi et al. | |
| 5,163,262 | A * | 11/1992 | Adams | B64G 9/00 52/111 |
| 5,228,258 | A * | 7/1993 | Onoda | B64G 9/00 343/915 |
| 6,748,962 | B2 * | 6/2004 | Miller | E04L 31/3211 135/120.3 |
| 7,963,084 | B2 * | 6/2011 | Merrifield | E04L 31/3441 52/117 |
| 9,555,871 | B2 * | 1/2017 | Grip | B64C 1/12 |
| 2002/0070024 | A1 * | 6/2002 | Schutz | B63B 21/502 166/350 |
| 2005/0226584 | A1 * | 10/2005 | Williams | D04C 1/02 385/130 |
| 2008/0250746 | A1 | 10/2008 | Nawrotski | |
| 2010/0005751 | A1 | 1/2010 | Troester | |
| 2013/0340373 | A1 * | 12/2013 | Santiago Prowald | B64G 1/222 52/646 |

FOREIGN PATENT DOCUMENTS

| | | |
|---|---|---|
| EP | 0 205 960 | 12/1986 |
| EP | 0 213 208 | 3/1987 |
| EP | 0 472 114 | 4/1999 |
| EP | 1699954 | 9/2006 |
| EP | 1 749 574 | 2/2007 |
| GB | 2 042 414 | 9/1980 |
| GB | 2 051 667 | 1/1981 |
| WO | WO 01/73173 | 10/2001 |
| WO | WO 03/002830 | 1/2003 |
| WO | WO 2008/058749 | 5/2008 |
| WO | WO 2012/139934 | 10/2012 |
| WO | WO 2014/210026 | 12/2014 |

OTHER PUBLICATIONS

M.P. Vlasblom and R.L.M. Bosman in *Predicting the Creep Lifetime of HMPE Mooring Rope Applications*, published in the abstracts of Ocean 2006 Conference, Boston MA, Sep. 2006, Publisher: IEEE, Print ISBN: 1-4244-0114-3.

H. N. A. M. Steenbakkers-Menting, "Chlorination of ultrahigh molecular weight polyethylene", *PhD Thesis, technical University of Eindhoven*, The Netherlands (1995).

* cited by examiner

STRUCTURES HAVING AT LEAST ONE POLYMERIC FIBER TENSION ELEMENT

CROSS-REFERENCE TO RELATED APPLICATIONS

This application is the U.S. national phase of International Application No. PCT/EP2015/064726 filed 29 Jun. 2015, which designated the U.S. and claims priority to EP Patent Application No. 14175156.0 filed 1 Jul. 2014, the entire contents of each of which are hereby incorporated by reference.

FIELD

The present invention relates to a statically determined structure or a statically over-determined structure comprising polymeric fibers. Furthermore, the invention directs to the use of said fibers in certain applications.

BACKGROUND AND SUMMARY

Such structures are generally known in the art, for instance from documents US2008/0250746A1; US2010/0005751; WO03/002830; and U.S. Pat. No. 5,125,206. Examples of common elements of such structures are tension elements and rigid elements, such as rods and beam ties that are typically interconnected by interconnecting elements, e.g. by welding together the rigid elements or by joints and hinges. The rigid elements are generally known as being able to resist tension, compression and bending loads. Prior art also describes statically under-determined structures. An example of a two-dimensional (2D) statically under-determined structure is illustrated in FIGS. 1*a* through 1*e* herein and comprises rigid elements (1), i.e. rods, interconnected by interconnecting elements (2), i.e. hinges; no force is applied to this structure. FIG. 2 shows a statically under-determined structure as depicted in FIG. 1*a* in a situation when forces F (force may also be herein referred to interchangeably as load) are applied to the structure and, as a result, the structure is deformed under diagonal compression forces F; such high deformation is normally allowed by the interconnecting elements. A statically under-determined structure is thus typically an unfavorable structure, as it allows large deformation under load, without loading the tension, compression and/or bending resistance of the rigid elements. Similar considerations are also valid for a three-dimensional (3D) statically under-determined structure.

A statically determined structure known in the art is shown in FIG. 3 in relation to the statically under-determined structure of FIG. 1*b*. The addition of a tension element (3), i.e. a rod, usually prevents the elongation of the distance between the lower left and the upper right interconnecting elements (2), i.e. hinges. In this way, the high deformation due to the forces F is typically prevented, making the structure stabile (e.g. it does not fail) in all cases of in-plane loading, including loads applied to the structure in other directions than the direction of loads F illustrated in FIG. 3.

Statically over-determined structures typically contain more structural elements than strictly necessary to carry external loads, with the consequence that such a structure may be loaded by internal forces, even in the case that the said structure is not externally loaded. When applying external loads to such a structure, said external forces generally increase the internal forces. The sum of the internal forces and the external forces may be higher than the load capacity of an individual structural element and thus may cause premature failure of said element, resulting in subsequent premature failure of the entire structure. The load capacity is herein defined as the force applied to the structure or an element of the structure under which said structure fails to resist the applied loads. An example of statically over-determined structure known in the art is shown in FIG. 4 in relation to a statically under-determined structure of FIG. 1*c*. FIG 4 shows the addition of another tension element to the structure depicted in FIG. 3, i.e. the rod (4) to form a statically over-determined structure. Such a structure typically resists any loads applied to it. However, to be an effective structure, the length of the rod (4) should be generally identical to the distance between the upper left and lower right-hand side hinges, because this distance was already established by adding the rod (3), as shown in FIG. 3. In the case that rod (4) is longer or shorter than said distance, the rod and the structure would have to be deformed in order to fit said distance. Such a deformation typically requires applying forces on the structure, including on the rigid elements. Such forces are normally undesirable internal forces that are still imposed on the structure when the structure is in service.

In prior art, mechanical devices, such as hydraulic devices are generally used to reduce internal forces on elements in statically determined or over-determined structures that could lead to premature failure. These mechanical devices commonly relieve internal loads on elements by changing the effective length of the elements. Prior art also discloses tension elements in such structures that comprise different materials used with the aim to stabilize internal loads. Examples of such materials include steel, polyester fibers, polyethylene fibers, aramid fibers. However, steel has heavy weight and is corrosive; in addition, in structures that use steel, initial length differences between different tension elements (e.g. tendons in marine platforms) need to be cancelled out by actively adjusting the height of the end fixtures of the tension elements by using expensive hydraulic devices. Polyester fibers show lower strength and therefore very thick tension elements, such as cables containing polyesters are needed, resulting in operational problems. Aramid fibers exhibit low abrasion resistance and lack chemical resistance especially when used in alkaline environments, such as in salty see water. Polyethylene fibers, particularly ultrahigh molecular weight polyethylene fibers (e.g. Dyneema® and Spectra®) exhibit excess minimum creep, that leads to creep failure of the structure. Such UHMWPE materials were for instance described by M. P. Vlasblom and R. L. M. Bosman in *Predicting the Creep Lifetime of HMPE Mooring Rope Applications*, published in the abstracts of Ocean 2006 Conference, Boston Mass., September 2006, Publisher: IEEE, Print ISBN: 1-4244-0114-3.

Furthermore, structures are generally designed for very long time service load and during that time varying loads generally occur. The magnitude of the loads may be a statistical distribution, e.g. loads due to wind gusts in storms. In addition, the design of the structures is typically made by adopting a very low chance of exceeding the design strength level of the structure during the life time, e.g. for an offshore platform it may be adopted that a chance is only e.g. 1/1000 that a storm occurs during an operational life time of the structure of e.g. 20 years, with a storm intensity being so high such that the design load levels that the structure resists are surpassed. The statistical expectation for such a high loading may be around the midlife of such a structure, the chance that it occurs in the first weeks of the life time of such a structure being extremely low. Moreover, present weather prediction models generally allow erecting such a structure at a timing that such a storm is typically not expected. An attractive strategy may be to erect such a platform at the time when bad weather conditions are very rare (e.g. in the summer). Consequently, a temporary strength reduction during the first week(s) or even months after erecting the structure is accepted, but it is desired that strength reduction is only temporary.

The objective of the present invention is therefore to provide a structure that avoids the disadvantages of the prior art, particularly to provide a structure that is very stable, allows internal loads to be reduced and thus avoids premature failure when internal and/or external forces are applied to said structure, without the need of using expensive mechanical devices and in the same time may be light weighted and have high mechanical strength.

This objective is surprisingly achieved by a structure comprising rigid elements connected together by interconnecting elements in such a way to form a statically determined structure or a statically over-determined structure, wherein said structure comprises at least one tension element comprising polymeric fibers having a stabilizing creep of at least 0.3% and at most 10% and a minimum creep rate lower than $1\times10^{-5}$% per second, said stabilizing creep and minimum creep being measured at a tension of 900 MPa and a temperature of 30° C. Even if the structure according to the present invention may undergo an accepted temporary strength reduction during the first week(s) after erecting, the strength reduction of the structure according to the present invention is surprisingly only temporary and thus said structure will show improved safety during the majority of its life time.

It is true that document DE102008005051B3 discloses such a structure. In particular, this document discloses a cable structure for cable tensioned space framework, the structure having a sleeve rotatably supported and being fixed around a longitudinal middle axis in a node element so that cable is stressed longitudinal and transversal to carrying direction. However, the structures described in this document comprise cables made of polymeric fibers (i.e. Kevlar®, i.e. a para-aramid synthetic fiber) that are different than the polymeric fibers according of the present invention and therefore the structures described in this document will prematurely fail when loads are applied to them. Document WO2014/210026A2 describes structures for tethering a subsea blowout preventer comprising anchors, tensioning systems and tensioning members. The tensioning members described in this document can include chains, wire rope or Dyneema® rope available from DSM Dyneema LLC of Stanley, N.C. USA. Said Dyneema® rope was made of fibers that have different properties than the fibers according to the present invention and therefore the structures described in this document will prematurely fail when loads are applied to them.

DETAILED DESCRIPTION

Figure 1A:
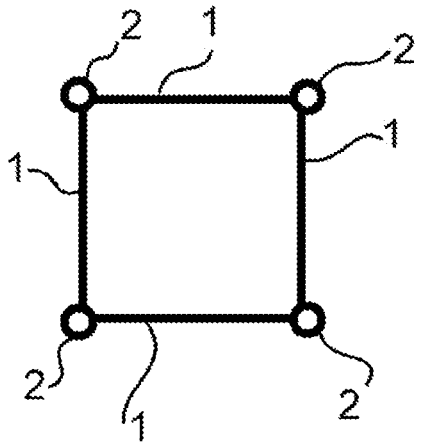
FIG. 1a (Prior Art)
FIGS. 1*a*-1*e* schematically depict examples of a two-dimensional (2D) statically under-determined structure known in the art.
Figure 2:
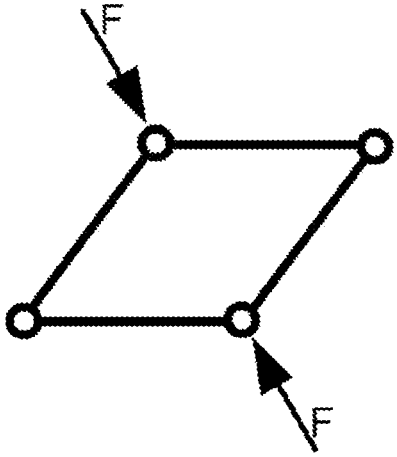
FIG. 2 (Prior Art)
FIG. 2 schematically depicts the statically under-determined structure of FIG. 1*a* in a situation when forces F are applied to the structure.
Figure 1B:
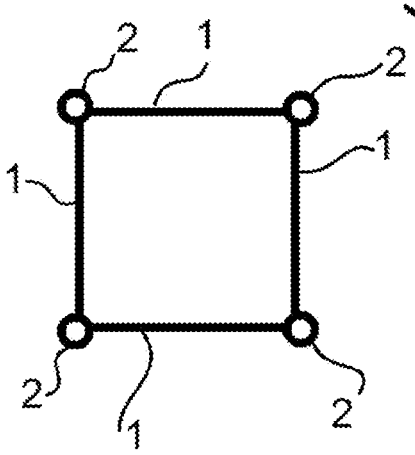
FIG. 1b (Prior Art)

In the context of the present invention, a statically determined structure is a structure that contains the minimum number of structural elements for the elementary functioning of the structure.

In the context of the present invention, a statically over-determined structure is a structure that contains more structural elements than necessary for elementary functioning of said structure or alternatively, said structural elements being constructed in such a way that internal forces are present in the structural elements, with or without the presence of any external forces. An example of a statically determined and over-determined structure is described, for instance, in WO2014/210026A2 document, which is incorporated herein by reference. Alternatively, a statically over-determined structure may be defined as a structure that when subjected to loading, the loading in the different structural tension elements may not occur in the same time (e.g. in the shorter tension elements, loading will occur earlier than in the longer tension elements) and the load differences upon loading will remain present until final loading is reached. The concept of being statically over-determined in the present invention is preferably limited to one loading direction only when more structural elements are subjected to forces in said loading direction. However, even if the structure are statically under-determined in other directions than said one loading direction, the present invention still applies.

The structure according to the present invention may be a rigid structure or a semi-rigid structure. A semi-rigid structure is herein a structure that is rigid in one loading direction only, e.g. when a tension element is compressed, said element only resists tension and not compression load.

A tension element in the structure according to the present invention is an element that deforms minimally under tension forces but deforms considerably under bending and/or compression forces, F. Tension forces are defined herein as at least two forces acting on one object, along the same line, oriented in opposite directions, away from one another, to stretch the object. Compression forces are defined herein as at least two forces acting on one object along the same line, oriented in opposite directions, towards one another, to compress or deform the object. Bending may be defined herein as the effect on a structural component of several forces that do not act along the same line; such forces cause a bending moment (sometimes denoted as torque). Tension tends to elongate an element. Compression tends to shorten an element. Bending tends to change an elements curvature.

The rigid elements in the structure according to the present invention are any known rigid elements in the art and may comprise any material like metals, e.g. steel, and aluminum; glass; ceramics; concrete; stone; composite materials and/or any combinations thereof. Examples of such rigid elements include rods and beam ties.

The interconnecting elements in the structure according to the present invention are any interconnecting elements known in the art and may comprise any material like metals, e.g. steel and aluminum; glass; ceramics; concrete; stone; composite materials and/or any combinations thereof. Such interconnecting elements may be movable, i.e. they may allow relative rotation between the rigid elements or they may be fixed to the rigid elements, e.g. as obtained by welding. Examples of such interconnecting elements include joints and hinges.

By "fiber" is herein understood to refer to an elongated body having a length much greater that its transverse dimensions, e.g. a diameter, a width and/or a thickness. The term fiber also includes e.g. a filament, a ribbon, a strip, a band, a tape, a film, a cable and the like. The fiber may have a regular cross-section, e.g. oval, circular, rectangular, square, parallelogram; or an irregular cross-section, e.g. lobed, C-shaped, U-shaped. The fiber may have continuous length, known in the art as filaments, or discontinuous lengths, known in the art as staple fibers. Staple fibers may be commonly obtained by cutting or stretch-breaking filaments. The fiber may have various cross-sections, e.g. regular or irregular cross-sections with a circular, bean-shape, oval or rectangular shape and they can be twisted or non-twisted. A yarn for the purpose of the invention is an elongated body containing a plurality of fibers. The skilled person may distinguish between continuous filament yarns or filament yarns, which contain continuous filament fibers and staple yarns or spun yarns containing short filament fibers also called staple fibers.

A plurality of fibers twisted or non-twisted may also be covered by a material to form a cable. Examples of such sheathing material include any polymer-based material, e.g. elastomers, thermoplastic polymers, thermoplastic elastomers and also metals. Preferably, said cable is tensioned to avoid slack and thus instable structural phenomena in the structure according to the present invention.

The at least one tension element in the structure according to the invention preferably comprises polymeric fibers having a stabilizing creep of at least 0.3%; more preferably at least 0.5%; yet more preferably at least 1%; most preferably at least 1.2%; and even most preferably at least 1.5% and preferably at most 8%, more preferably at most 7%; yet more preferably at most 6%; most preferably at most 5%; yet most preferably at most 2.5%; and yet most preferably at most 2%, measured at a tension of 900 MPa and a temperature of 30° C. The fibers in the at least one tension element in the structure of the present invention also have a minimum creep rate lower than about $1\times10^{-6}$% per second, preferably lower than about $4\times10^{-6}$% per second, most preferably lower than about $2\times10^{-6}$% per second, measured at a tension of 900 MPa and a temperature of 30° C. Most preferably, the minimum creep rate is at most about 0% per second. Said at least one tension element in the structure according to the present invention reduces internal forces and thus controls adjustment of all undesired length differences of each rigid element, individually, when said structure is subjected to in-service loads avoiding premature failure when internal and/or external forces are act on said structure, without the need to use mechanical devices and in the same time is light weighted and has high mechanical strength. In addition, said at least one tension element shows no corrosion and has high abrasion resistance properties and chemical resistance.

The stabilizing creep and the minimum creep of the polymeric fibers in the structure according to the present invention may be measured by the methods as described in the Examples—Methods of characterization section of the present invention. Particularity, the creep properties of the fiber in the structure according to the present invention have been derived herein from a creep measurement applied on multifilament yarns by applying ASTM D885M standard method under a constant load of 900 MPa, at a temperature of 30° C. and then measuring the creep response (i.e. elongation, %) as a function of time. The minimum creep rate is herein determined by the first derivative of creep as function of time, at which this first derivative has the lowest value. The stabilizing creep is herein defined as the creep amount that is determined by the intersection point of the tangent of the creep curve at the point of minimum creep rate with the vertical axis (elongation, %). The so obtained first approximation of the stabilizing creep value is corrected to the value of the elastic strain (i.e. the elastic strain value has to be subtracted from the first estimation of the stabilizing creep value) in order to obtain the actual stabilizing creep value.

The polymeric fibers having a stabilizing creep of at least 0.3% and at most 10% and a minimum creep rate lower than $1\times10^{-5}$% per second, said stabilizing creep and minimum creep being measured at a tension of 900 MPa and a temperature of 30° C. in the structure according to the present invention may be also be referred to herein interchangeably as "creep stabilizing fibers". Creep is a parameter already known in the art and it typically depends on the tension and the temperature applied on a material. High tension and high temperature values typically promote fast creep behavior. The creep stabilizing fibers have thus a creep rate that decreases to negligible values, preferably to zero with increasing the amount of creep. Fibers having a certain stabilizing creep are herein fibers showing time dependent behavior, e.g. creep and/or stress-relaxation, and may be also referred to herein as fibers showing visco-elastic or visco-plastic behavior, which are terms known for the skilled person in the art. Fibers having stabilizing creep behavior may also mean alternatively fibers that show elastic deformation and creep deformation when a load is applied to said fibers. The creep may be reversible or irreversible on unloading. The rate of time dependent deformation is called creep rate and is a measure of how fast the fibers are undergoing said deformation. The initial creep rate may be high but the creep deformation may decrease during constant loading to a final creep rate that may be negligible (e.g. close to zero value) or even zero.

The creep stabilizing fibers in the at least one tension element in the structure according to the present invention may comprise any polymer and/or polymer composition. Preferably, the polymeric fibers comprise high performance polymeric fibers. In the context of the present invention, high performance polymeric fibers are understood to include fibers (preferably comprising semicrystalline polymers) selected from a group comprising or consisting of polyolefins, such as homopolymers and/or copolymers of alpha-olefins, e.g. ethylene and/or propylene; polyoxymethylene; poly(vinylidine fluoride); poly(methylpentene); poly(ethylene-chlorotrifluoroethylene); polyamides; polyarylates; poly (tetrafluoroethylene) (PTFE); poly(hexamethyleneadipamide) (known as nylon 6,6); polybutene; polyesters, e.g. poly(ethylene terephthalate), poly(butylene terephthalate), and poly(1,4 cyclohexylidene dimethylene terephthalate); polyacrylonitriles; polyvinyl alcohols and thermotropic liquid crystal polymers (LCP) as known from e.g. U.S. Pat. No.

4,384,016. The methods of manufacturing of these polymers and fibers thereof are known to the skilled person in the art and extensively already described in the prior art. Also combinations of fibers manufactured from such polymeric materials by any method known in the art can be used for making the creep stabilizing fibers in the structure according to the present invention.

Preferably, the creep stabilizing fibers in the at least one tension element in the structure according to the present invention comprise polyolefin fibers, preferably high performance polyolefin fibers, preferably alpha-polyolefins, such as propylene homopolymer and/or ethylene homopolymers and/or copolymers comprising propylene and/or ethylene. More preferably, said polyolefin is a polyethylene homopolymer, even more preferably high performance polyethylene, and most preferably high molecular weight polyethylene (HMWPE) or ultrahigh molecular weight polyethylene (UHMWPE), as this allows internal loads to be reduced and thus avoiding premature failure when internal and/or external forces are applied to said structure, without the need to use mechanical devices and in the same time is light weighted, non-corrosive, shows high abrasion resistance properties and chemical resistance, and has high mechanical strength.

By "high performance yarns" or "high performance fibers" may be understood herein to include yarns (or fibers), preferably polymeric yarns (or fibers), having a tenacity or tensile strength of at least 1.2 N/tex, more preferably at least 2.5 N/tex, most preferably at least 3.5 N/tex, yet most preferably at least 4 N/tex. For practical reasons, the tenacity or tensile strength of the high performance yarns may be at most 10 N/tex. The tensile strength may be measured by the method as described in the "Examples" section herein below.

The tensile modulus of the high performance yarns or fibers may be of at least 40 GPa, more preferably at least 60 GPa, most preferably at least 80 GPa. The titer of the fibers in said yarn is preferably at least 100 dtex, even more preferably at least 1000 dtex, yet even more preferably at least 2000 dtex, yet even more preferably at least 3000 dtex, yet even more preferably at least 5000 dtex, yet even more preferably at least 7000 dtex, most preferably at least 10000 dtex.

The at least one tension element in the structure according to the present invention may comprise at least 50 wt %, preferably at least 70 wt %, more preferably at least 80%, most preferably at least 90 wt % or even 100 wt % of the creep stabilizing polymeric fiber.

By "UHMWPE" is herein understood a polyethylene having an intrinsic viscosity (IV) as measured on solution in decalin at 135° C., of preferably at least 5 dl/g. Preferably, the IV of the UHMWPE is at least 10 dl/g, more preferably at least 15 dl/g, even more preferably at least 19 dl/g, most preferably at least 21 dl/g. Preferably, the IV is at most 40 dl/g, more preferably at most 30 dl/g, even more preferably at most 25 dl/g. Intrinsic viscosity is a measure for molecular weight (also called molar mass) that can more easily be determined than molecular weight parameters like $M_n$ and $M_w$. When the intrinsic viscosity is too low, the strength necessary for using various produced articles from the UHMWPE sometimes cannot be obtained, and when it is too high, the processability, etc. upon fiber production is often very difficult. The average molecular weight ($M_w$) and/or the intrinsic viscosity (IV) of said polymeric materials can be easily selected by the skilled person in order to obtain fibers having desired mechanical properties, e.g. tensile strength. The technical literature provides further guidance not only to which values for $M_w$ or IV a skilled person should use in order to obtain strong fibers, i.e. fibers with a high tensile strength, but also how to produce such fibers.

Preferably, the fibers comprising UHMWPE are gel-spun fibers, i.e. fibers manufactured with a gel-spinning process or are melt-spun fibers. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1 and EP 1,699,954.

Most preferably, the polymeric fiber in the at least one tension element in the structure according to the present invention comprise a polyethylene, preferably a high performance polyethylene and most preferably UHMWPE comprising olefinic branches (OB) as creep stabilizing fibers. Such a UHMWPE fiber is for instance described in document WO2012139934, included herein by reference. The OB may have a number of carbon atoms between 1 and 20, more preferably between 2 and 16, even more preferably between 2 and 10 and most preferably between 2 and 6. Good results in terms of fibre drawability and stabilizing creep are obtained when said branches are preferably alkyl branches, more preferably ethyl branches, propyl branches, butyl branches or hexyl branches and most preferably ethyl or butyl branches. The number of olefinic, e.g. ethyl or butyl, branches per thousand carbon atoms can be determined by FTIR on a 2 mm thick compression moulded film by quantifying the absorption at 1375 $cm^{-1}$ using a calibration curve based on NMR measurements as in e.g. EP 0 269 151 (in particular page 4 thereof).

The UHMWPE also has preferably an amount of olefinic branches per thousand carbon atoms (OB/1000C) of between 0.01, more preferably 0.05 and 1.30, more preferably between 0.10 and 1.10, even more preferably between 0.30 and 1.05. When the UHMWPE used according to the invention has ethyl branches, preferably said UHMWPE has an amount of ethyl branches per thousand carbon atoms (C2H5/10000) of between 0.40 and 1.10, more preferably between 0.60 and 1.10, also more preferably between 0.64 and 0.72 or between 0.65 and 0.70 and most preferably between 0.78 and 1.10, also most preferably between 0.90 and 1.08, or between 1.02 and 1.07. When the UHMWPE used according to the invention has butyl branches, preferably said UHMWPE has an amount of butyl branches per thousand carbon atoms (C4H9/1000C) of between 0.05 and 0.80, more preferably between 0.10 and 0.60, even more preferably between 0.15 and 0.55, most preferably between 0.30 and 0.55.

Preferably, the fiber comprising UHMWPE is obtained by spinning an UHMWPE comprising olefinic branches and having an elongational stress (ES), and a ratio (OB/1000C)/ES between the number of olefinic branches per thousand carbon atoms (OB/1000C) and elongational stress (ES) of at least 0.2 and more preferably of at least 0.5. Said ratio can be measured wherein said UHMWPE fibre is subjected to a load of 600 MPa at a temperature of 70° C., has a creep lifetime of at least 90 hours, preferably of at least 100 hours, more preferably of between 110 hours and 445 hours, preferably at least 110 hours, even more preferably of at least 120 hours, most preferably of at least 125 hours. Preferably the UHMWPE has an intrinsic viscosity (IV) of at least 5 dl/g. The elongational stress (ES in $N/mm^2$) of an UHMWPE can be measured according to ISO 11542-2A.

The UHMWPE has preferably a ratio (OB/1000C)/ES of at least 0.3, more preferably of at least 0.4, even more preferably of at least 0.5, yet even more preferably of at least 0.7, yet even more preferably of at least 1.0, yet even more preferably of at least 1.2. When the UHMWPE used in the present invention has ethyl branches, said UHMWPE preferably has a ratio (C2H5/1000C)/ES of at least 1.00, more preferably of at least 1.30, even more preferably of at least 1.45, yet even more preferably of at least 1.50, most preferably of at least 2.00. Preferably said ratio is between 1.00 and 3.00, more preferably between 1.20 and 2.80, even more preferably between 1.40 and 1.60, yet even more preferably between 1.45 and 2.20. When the UHMWPE has butyl branches, said UHMWPE preferably has a ratio (C4H9/1000C)/ES of at least 0.25, even more preferably at least 0.30, yet even more preferably at least 0.40, yet even more preferably at least 0.70, more preferably of at least 1.00, most preferably of at least 1.20. Preferably said ratio is between 0.20 and 3.00, more preferably between 0.40 and 2.00, even more preferably between 1.40 and 1.80.

The UHMWPE has preferably an ES of at most 0.70, more preferably of at most 0.50, more preferably of at most 0.49, even more preferably at most 0.45, most preferably at most 0.40. When said UHMWPE has ethyl branches, preferably said UHMWPE has an ES of between 0.30 and 0.70, more preferably between 0.35 and 0.50. When said UHMWPE has butyl branches, preferably said UHMWPE has an ES of between 0.30 and 0.50, more preferably between 0.40 and 0.45.

Preferably, the UHMWPE fibre is obtained by gel-spinning an UHMWPE comprising ethyl branches and having an elongational stress (ES), wherein the ratio (C2H5/1000C)/ES between the number of ethyl branches per thousand carbon atoms (C2H5/1000C) and the elongational stress (ES) is at least 1.0, wherein C2H5/1000C is between 0.60 and 0.80 or between 0.90 and 1.10 and wherein the ES is between 0.30 and 0.50. Preferably, the UHMWPE has an IV of at least 15 dl/g, more preferably at least 20 dl/g, more preferably at least 25 dl/g. Preferably, the UHMWPE fiber has a creep lifetime of at least 90 hours, preferably of at least 150 hours, more preferably of at least 200 hours, even more preferably of at least 250 hours, most preferably of at least 290 hours and also most preferably of at least 350 hours.

Preferably, the UHMWPE fiber is obtained by gel-spinning an UHMWPE comprising butyl branches and having an elongational stress (ES), wherein the ratio (C4H9/1000C)ES between the number of butyl branches per thousand carbon atoms (C4H9/1000C) and the elongational stress (ES) is at least 0.5, wherein C4H9/1000C is between 0.20 and 0.80 and wherein the ES is between 0.30 and 0.50. Preferably, the UHMWPE has an IV of at least 15 dl/g, more preferably at least 20 dl/g. Preferably, the fiber has a creep lifetime of at least 90 hours, more preferably of at least 200 hours, even more preferably of at least 300 hours, yet even more preferably of at least 400 hours, most preferably of at least 500 hours.

The polyolefin, preferably polyethylene and most preferably UHMWPE that may be used in or as creep stabilizing fiber in the at least one tension element in the structure according to the present invention may be obtained by any process known in the art. A suitable example of such process known in the art is a slurry polymerisation process in the presence of an olefin polymerisation catalyst at a polymerisation temperature. Said process may comprise, for instance, the steps of: a) charging a reactor, e.g. a stainless steel reactor with a-i) a non-polar aliphatic solvent having a boiling point at a temperature higher than the polymerization temperature. Said polymerisation temperature may be preferably between 50° C. and 90° C., more preferably between 55° C. and 80° C., most preferably between 60° C. and 70° C. The boiling point of said solvent may be between 60° C. and 100° C. Said solvent may be chosen from the group comprising heptane, hexane, pentamethylheptane and cyclohexane; a-ii) an aluminium alkyl as co-catalyst such as triethylaluminium (TEA) or triisobutylaluminium (TIBA); a-iii) an olefin gas, preferably ethylene gas, to a pressure between 0.1 and 6 bar, preferably between 1 and 4 bar, most preferably between 1.8 and 3.2 bar; a-iv) an alpha-olefinic comonomer; and iv) a catalyst suitable of producing a polyolefin, preferably a polyethylene, most preferably UHMWPE under the conditions a)-i) to a)-iv), said catalyst being preferably a Ziegler-Natta catalyst. Ziegler-Natta catalysts are known in the art and are, for instance, described in WO 2008/058749 or EP 1 749 574 included herein by reference; then b) gradually increasing the olefin gas pressure inside the reactor, e.g. by adjusting the gas flow, to reach a gas pressure of preferably at most 12 bar during the course of the polymerization process; and c) producing polyolefin, preferably polyethylene and most preferably UHMWPE that may be in the form of powder or particles that may have an average particle size (D50) as measured by ISO 13320-1 of between 80 μm and 300 μm, more preferably of between 100 μm and 200 μm, most preferably of between 140 μm and 160 μm.

The alpha-olefinic comonomer may be chosen with due regard to the type of branching required. For instance, in order to produce a polyolefin, preferably a polyethylene and most preferably UHMWPE having ethyl branches, the alpha-olefinic comonomer is butene, more preferably 1-butene. The ratio of gas:total ethylene (NL:NL) in case a polyethylene, preferably UHMWPE is used may be at most 325:1, preferably at most 150:1, most preferably at most 80:1; wherein by total ethylene is understood the ethylene added in steps a)-iii) and b). In order to produce a polyolefin, preferably a polyethylene and most preferably UHMWPE having butyl, e.g. n-butyl, or hexyl branches, the olefinic comonomer is 1-hexene or 1-octene, respectively. Preferably, by butyl branches are herein understood n-butyl branches.

The creep stabilizing fibers in the at least one tension element in the structure according to the present invention may alternatively contain polymers, preferably polyolefins, more preferably polyethylenes and most preferably UHMWPE that comprise chlorine side groups on the main polymer chain. Such fibers may be obtained by any methods already known in the art, e.g. by chlorination of a polyolefin, preferably polyethylene and most preferably UHMWPE. Such chlorination methods are described for instance in the published dissertation thesis *H. N. A. M. Steenbakkers-Menting, "Chlorination of ultrahigh molecular weight polyethylene", PhD Thesis, technical University of Eindhoven, The Netherlands* (1995), document incorporated herein by reference. This document describes, for instance, chlorination of PE powder in suspension at 20-40° C.; in a rotating drum at 90° C. and in solution. Fibers comprising polyethylenes, e.g. HDPE and UHMWPE having variable amounts of chlorine groups are described in this document.

The structure according to the present invention comprises at least one tension element comprising the creep stabilizing fibers according to the present invention and may optionally comprise at least one additional tension element, which comprise no creep stabilizing fibers. The at least one additional tension is a tension element as already known in the prior art, and typically comprise fibers comprising any material known in the art to be used for this purpose (e.g. aramid fibers (e.g. Kevlar®, Twaron®, steel, polyester fibers) and is free of any creep stabilizing fibers as defined in the present invention (i.e. comprise 0 wt % creep stabilizing fibers). The "at least one tension element" may be also referred interchangeably to herein as "the at least one tension element A". The "at least one additional tension element" may be also referred interchangeably to herein as "the at least one tension element B".

Figure 3:
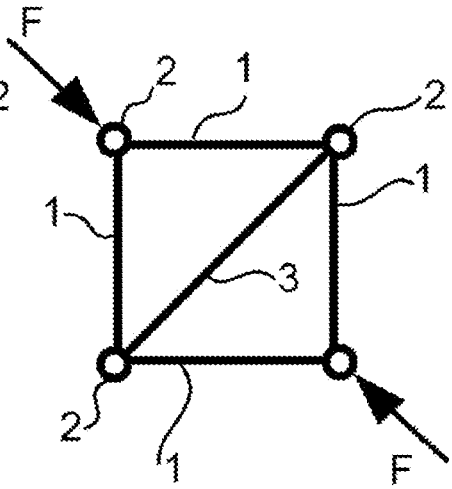
FIG. 3 (Prior Art)
FIG. 3 schematically depicts a statically determined structure known in the art relation to a statically under-determined structure of FIG. 1*b*.
Figure 1C:
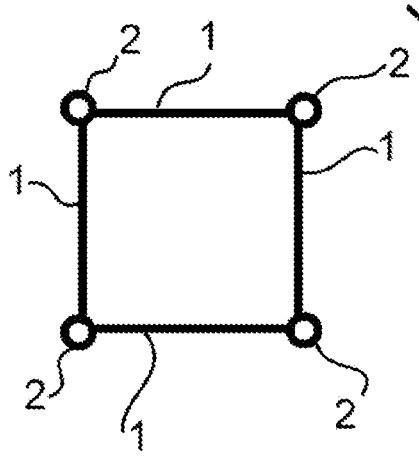
FIG 1c (Prior Art)
Figure 4:
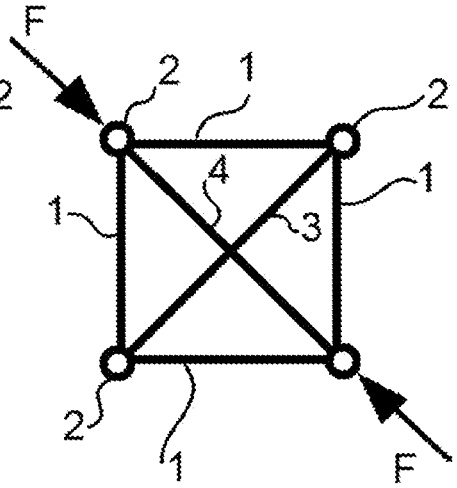
FIG. 4 (Prior Art)
FIG. 4 schematically depicts a statically over-determined structure in relation to a statically under-determined structure of FIG. 1*c*.
Figure 1D:
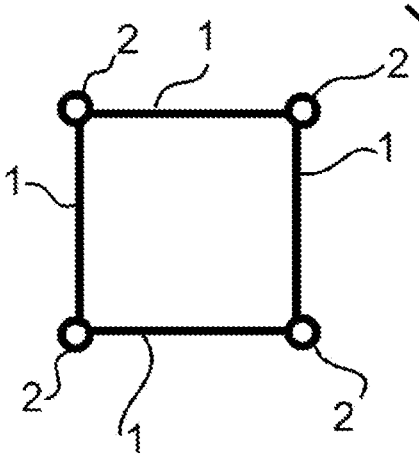
FIG. 1d (Prior Art)
Figure 5:
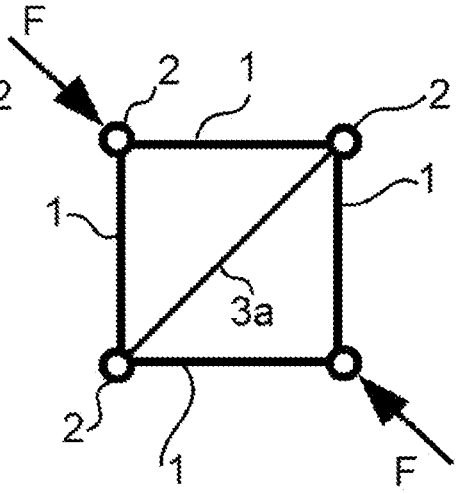
FIG. 5 schematically depicts a statically over-determined structure according to the invention in relation to a statically under-determined structure of FIG. 1*e;*

A statically determined structure according to the invention is, for instance, illustrated in FIG. 5 in relation to a statically under-determined structure of FIG. 1*d*. As shown, the structure of FIG. 5 is the same structure as in structure of FIG. 3, the only difference being that the rigid element (3) in the structure FIG. 3, i.e. the rod, is replaced in the structure of FIG. 5 by a tension element (3*a*) comprising the creep stabilizing fibers as defined in the present invention, which may be also referred to herein as the first tension element. The statically determined structure in FIG. 5 deforms minimally when applying forces F, because it imposes a tensile force on the tension element. In the case that the compression forces F may not be applied on the upper left and lower right, but on the upper right and lower left-hand interconnecting elements, e.g. hinges shown in FIG. 4, the tension element may collapse and not resist the load and as a result, deformation may occur in the opposite direction of F in FIG. 1*c*.

Figure 1E:
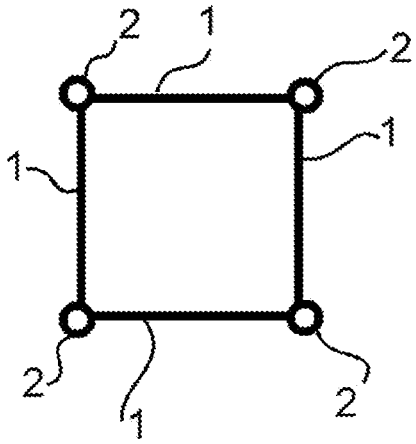
Figure 6:
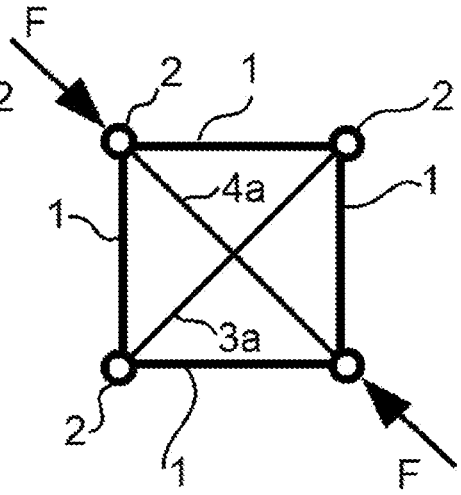

In order to have a structure that better resists all in plane forces applied to said structure, the structure according to the invention comprises at least two tension elements, preferably comprising the stabilizing fibers according to the invention, which makes the structure statically over-determined. Although there is no limitation on the upper limit of the number of the tension elements, for practical reasons only, the statically over-determined structure according to the present invention preferably comprises a limited number of tension elements. This number will be dependent on the design details of the type of structure (e.g. on the geometry and function of the structure). Such a situation is depicted, for instance, in FIG. 6 in relation to a statically under-determined structure of FIG. 1*e*. As shown in FIG. 6, a statically over-determined structure according to the present invention additionally comprises tension element (4*a*), which may be also referred to herein as the second tension element. Due to the second tension element, the structure in FIG. 6 is not limited anymore to resist only one load direction. It also resists a compression load between the upper right-hand and lower left-hand corner.

The structure of the present invention preferably comprises up to three tension elements comprising no stabilizing creep fibers (i.e. tension elements A) and at least one additional tension element comprising creep stabilizing fibers having stabilizing creep of at least 0.3% and at most 10% and a minimum creep rate lower than $1\times10^{-5}$% per second, said stabilizing creep and minimum creep being measured at a tension of 900 MPa and a temperature of 30° C. (i.e. at least one additional tension element B).

The structure of the present invention more preferably comprises up to three tension elements comprising no stabilizing creep fibers (i.e. tension elements A) and at least one additional tension element comprising creep stabilizing fibers having stabilizing creep of at least 0.3% and at most 10% and a minimum creep rate lower than $1\times10^{-5}$% per second, said stabilizing creep and minimum creep being measured at a tension of 900 MPa and a temperature of 30° C. (i.e. at least one additional tension element B), whereas the total amount of tension elements is at least four, preferably at least five, more preferably at least six. Such a structure is a statically over-determined structure, for instance a marine platform (or water-buoyant platform). In such structure the internal forces are reduced and all undesired length differences in each tension element, such as in each tendon, individually, are controlled and adjusted when said marine platform is subjected to in-service loads avoiding thus premature failure when internal and/or external forces are acting on said structure, without the need to use mechanical devices. Additionally, the tilt of said platform due to the imbalance in loads resulting from length differences of the tendons is small. Moreover, said marine platform is light weighted and has high mechanical strength. Preferably, in case tendons have different lengths (i.e. too long or too short), said tendons are positioned adjacent to the tendons having the same length. Preferably, the marine platform comprises at least 4 tendons or at least 5 tendons or at least 6 tendons.

Said marine platform may float on the water or may be submerged below a surface water. Said marine platform can be for instance tethered to anchors at the sea floor with tension elements, such as cables. In a 2D configuration, depending on the geometry, three tension elements that may be in plane may cause a statically over-determined behavior in the vertical direction for said platforms. In a 3D configuration, a number of four or more tension elements (e.g. up to ten) that are typically used to tether the platform to anchors at the sea floor, to provide resistance to vertical and rotational platform motion. Such a platform may be, at the same time, a statically under-determined, determined, or over-determined structure in the horizontal direction. Other examples of the structures of the invention may be high masts comprising at least one tension element comprising the stabilizing fibers, e.g. cables that may be used in inclined position. Some examples are illustrated in FIGS. 7-15.

Figure 7:
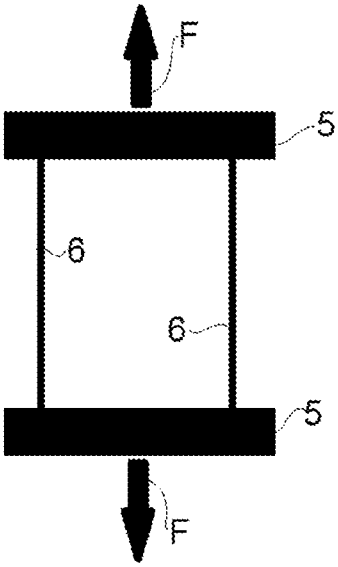
FIGS. 7-15 schematically depict other structures that may embody the present invention.
Figure 8:
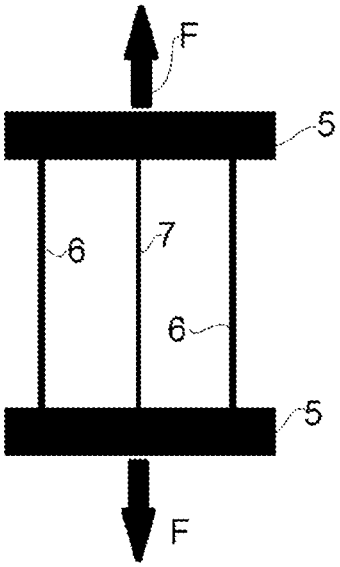

FIG. 7 shows a prior art 2D statically determined structure consisting of two rigid elements (5), connected with two tension elements (6), e.g. rods or cables, which are slender and flexible. The slenderness of elements (6) implies that some bending of said elements does not cause considerable stresses in those elements. The vertical load F acting on the rigid elements (5) is equally distributed over elements (6). The rigidity of elements (5) is sufficiently high that all deformations can be neglected. If there is no external load, elements (6) are also unloaded. FIG. 8 shows a similar structure as in FIG. 7, with the difference that it contains an additional tension element (7). In the case that element (7) has a length different from elements (6), residual internal forces may occur, causing element (7) to have an internal load different from those of elements (6) and the internal forces on either element (7) or elements (6) will be greater than the mean load shared among the three elements, which could lead to premature failure of the more heavily-loaded elements or in an alternative wording, the load distribution is unequal. The 2D structure in FIG. 8 is a statically over-determined structure.

In a 3D configuration of the structure according to FIG. 8 (not presented herein), the structure with two rigid elements (5) is a statically determined structure when there are three elements (6) that may be flexible. In case a fourth element (6) is added, the structure becomes a statically over-determined structure. However, adding four or more tension elements between the rigid bodies (5) may raise the problem of internal loads and the structure may result in premature failure due to loading. In case at least one of said tension elements comprise the creep stabilizing fibers according to the present invention, premature failure of the structures in FIGS. 7 and 8 will not occur. A preferred example of a 3D structure of FIG. 8 (not presented herein) is a tension leg platform, particularly an offshore tension leg platform, wherein the lower rigid element may be the sea floor, the upper rigid element may be the platform; and force F is the buoyancy force of the floating upper rigid element, e.g. the platform. An example of such platform is given in document WO2014/210026 document, which is incorporated herein by reference. The three tension elements may be cables, which distribute equally the buoyancy force. Such a structure is a statically determined structure. If more than three tension elements, e.g. 10 cables are applied, the structure becomes statically over-determined. However, applying four or more cables may be necessary, e.g. to resist displacements due to sea currents, but also may result in premature failure of the structure due to the combination of internal forces and the buoyancy force or in an alternative wording, due to unequal load distribution. But in case at least one tension element comprise the creep stabilizing fibers, according to the present invention, the premature failure of the structure is prevented.

Figure 9:
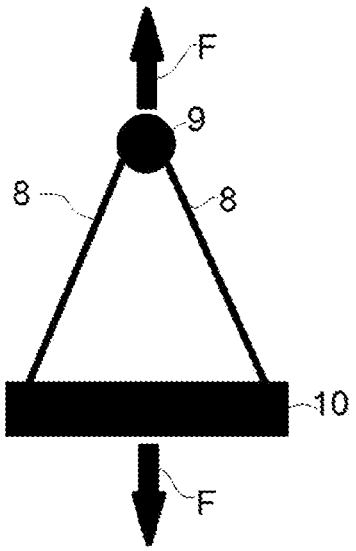
Figure 10:
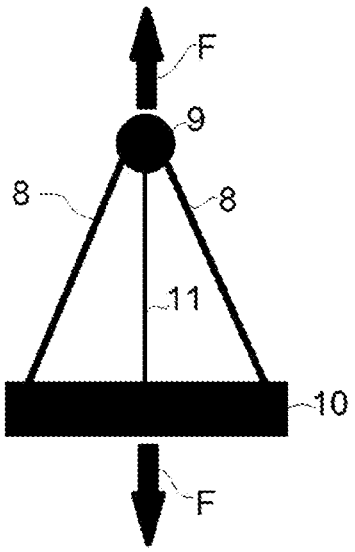

The statically determined 2D structure shown in FIG. 9 consists of a rigid element (10), a rigid interconnecting element (9) and two tension elements (8), e.g. cables or rods. The rigid element (10) is subjected to load F, e.g. by gravity in case of lifting. The force F applied on the rigid element is in equilibrium with the force F applied on the interconnecting element, e.g. F is a lifting force. The force F may be equally distributed over two tension (also called herein slender) elements (8). The statically over-determined structure in FIG. 10 comprises an additional tension element (11) compared with the structure in FIG. 9. If tension element (8) or (11) is too short or too long, unequal load distribution occurs and premature failure of the structure may result. In case at least one of said tension elements comprise the creep stabilizing fibers according to the present invention, premature failure of the structures in FIGS. 9 and 10 will not occur.

Figure 11:
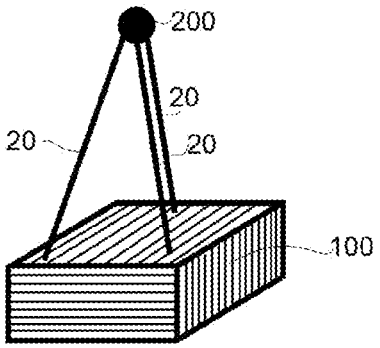
Figure 12:
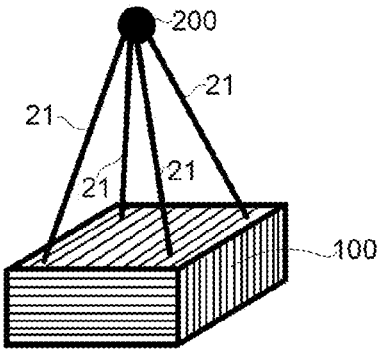

A 3D lifting, statically determined structure is shown in FIG. 11. The rigid element (100) is suspended at interconnecting element (200). The three tension elements (20), e.g. cables, share the load without the occurrence of internal forces. A statically over-determined structure is obtained if a fourth tension element is added, as illustrated in FIG. 12. In the case that one of the elements (20) or (21) is too long or too short to reach the distance to rigid element (100) without stretching, unequal load distribution occurs and premature failure of the structure may result. By applying in one or more of said tension elements the creep stabilizing fibers according to the present invention, premature failure of the structures in FIGS. 11 and 12 is avoided.

Figure 13:
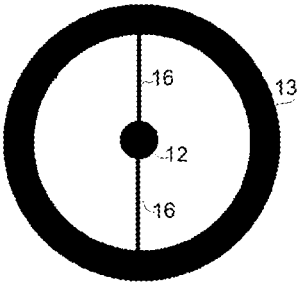
Figure 14:
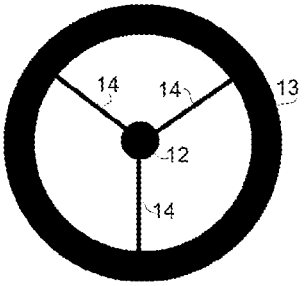
Figure 15:
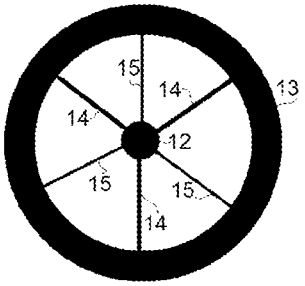

A further example is illustrated in FIG. 13, which shows a wheel consisting of an interconnecting element (12), e.g. an axle, a rigid element (13), i.e. a rim and two tension elements (16), e.g. spokes. The function of the spokes is load transfer from rim to axle. The spokes are all vertically positioned, so the wheel will only effectively resist a vertical load in the spoke direction (vertical if the wheel is not yet rotated). If one of the spokes (16) is too short to reach the distance to the rigid element (13) without stretching, the wheel is a statically over-determined structure, but not fully functional, as the wheel in FIG. 13 is not able to carry horizontal loads. FIG. 14 shows the same wheel as in FIG. 13 but having preferably three spokes (14). However, even if such a wheel may resist forces in all directions in the wheel plane, the disadvantage of such a structure is high bending load in the rim, when the rim is loaded in the middle (between two rim-spoke connections). Such bending resistance is typically less efficient in structures than tension or compression resistance and may result in premature failure of the statically over-determined structure. Applying more spokes as shown in FIG. 15 will reduce rim bending further but increase the over-determined character of the structure. In case at least one of said tension elements comprise the creep stabilizing fibers according to the present invention, premature failure of the structures in FIGS. 13-15 will not occur.

Furthermore, the invention also relates to a fiber having a stabilizing creep of at least about 0.3% and at most about 10% and a minimum creep rate lower than about $1\times10^{-5}$% per second, said stabilizing creep and minimum creep being measured at a tension of 900 MPa and a temperature of 30° C. Such a fiber having the combination of the certain stabilizing creep value and minimum creep rate value reduces internal forces and thus controls adjustment of all undesired length differences of a rigid element, individually, in a statically determined or a statically over-determined structure, preferably in a statically over-determined structure as defined herein, when said structure is subjected to in-service loads and avoiding premature failure when internal and/or external forces are act on said structure, without the need of using expensive mechanical devices and. In the same time the structures comprising said fiber are light weighted, have high mechanical strength, show no corrosion and have high abrasion resistance properties and chemical resistance. Such a fiber has the same characteristics and features as defined in the present invention.

The invention further relates to the use of polymeric fibers having a stabilizing creep of at least about 0.3% and at most about 10% and a minimum creep rate lower than $1\times10^{-5}$% per second, said stabilizing creep and minimum creep being measured at a tension of 900 MPa and a temperature of 30° C., in a statically determined structure or a statically over-determined structure, preferably in a statically over-determined structure. Suitable examples of said structures, preferably of statically over-determined structures include a framing structure, preferably a space frame; a suspended body; a platform, preferably a marine platform; or a wheel comprising spokes. Such a fiber has the same characteristics and features as defined in the present invention. By using said fibers in said structure, preferably in at least one tension element of said structure, the structure is very stable, allowing internal loads to be reduced and thus avoiding premature failure when internal and/or external forces are applied to said structure, without the need of using expensive mechanical devices In the same time, by using said fibers in said structures, the structures are light weighted, have high mechanical strength, show no corrosion and have high abrasion resistance properties and chemical resistance.

It is noted that the invention relates to all possible combinations of features recited in the claims. Features described in the description may further be combined.

It is further noted that the term 'comprising' does not exclude the presence of other elements. However, it is also to be understood that a description on a product comprising certain components also discloses a product consisting of these components. Similarly, it is also to be understood that a description on a process comprising certain steps also discloses a process consisting of these steps.

The invention will be further elucidated with the following examples without being limited hereto.

EXAMPLES

Methods of characterization

IV: the Intrinsic Viscosity for UHMWPE is determined according to ASTM D1601-99 (2004) at 135° C. in decalin, with a dissolution time of 16 hours, with BHT (Butylated Hydroxy Toluene) as anti-oxidant in an amount of 2 g/l solution. IV is obtained by extrapolating the viscosity as measured at different concentrations to zero concentration.

dtex: fibers' titer (dtex) was measured by weighing 100 meters of fiber. The dtex of the fiber was calculated by dividing the weight in milligrams to 10.

Tensile properties of fibers, particularly of the structures according to the Examples and Comparative Experiments herein comprising three multifilament yarns structures: tensile strength (or strength) and tensile modulus (or modulus) and elongation at break (or elongation at fracture), force at break were defined and determined on the three multifilament yarns as specified in ASTM D885M, using a nominal gauge length of the fiber of 500 mm, a crosshead speed of 5%/min (elongation rate of about 25 mm/min), at room temperature (about 23° C.) and about 50% relative humidity and using cylinders as end fixtures for the yarn. The tests were done using two cylinders having a diameter of 12 mm as end-fixtures for the yarn, the yarn being wound 12 times around each cylinder (in general, the yarn can be wound at least 12 times around each cylinder) and then fixated (i.e. by a knot) to a hook at the bottom of each cylinder. On the basis of the measured stress-strain curve, the modulus of the fibers may be determined as the gradient between 0.3 and 1% strain. For calculation of the modulus and strength, the tensile forces measured are divided by the titer, as determined by weighing 10 metres of fiber; values in GPa are calculated assuming a density of 0.97 g/cm$^3$.

Tensile properties of Dyneema® DM20, Dyneema® SK75 and Twaron® single yarns: tensile strength (or strength) and tensile modulus (or modulus) and elongation at break (or elongation at fracture) were measured on multifilament yarns as specified in ASTM D885M, using a nominal gauge length of the fibre of 500 mm, a elongation rate of 250 mm/min and Instron 2714 clamps, of type "Fibre Grip D5618C", at room temperature (about 23° C.) and about 50% relative humidity. On the basis of the measured stress-strain curve, the modulus of the fibers may be determined as the gradient between 0.3 and 1% strain. For calculation of the modulus and strength, the tensile forces measured are divided by the titer, as determined by weighing 10 metres of fiber; values in GPa are calculated assuming a density of 0.97 g/cm$^3$.

The theoretical maximum achievable strength is the sum of the individual yarn strength values. The tests at fracture used in the present application were designed for equal strength at theoretical maximum. This was obtained by using in the tests yarns of approximately equal length. In practice, this maximum theoretical value is typically not reached because length differences cannot be avoided and therefore it may be also referred to as the maximum practical initial strength. This situation is simulated in the test to fracture by reducing the length of the middle yarn with about 1.5% compared with the length of the other two yarns and then measuring the strength (examples "B"). In a next test (examples "C"), a similar set-up was used but now about 1.5% yarn length difference was loaded for 2 weeks at 60% of the load level measured in example B. After 2 weeks, the fracture load was measured and the results are presented herein in Table 1.

Creep lifetime and elongation during the creep lifetime were determined as described in document WO2012139934.

Stabilizing creep and minimum creep rate in the fibers

Figure 16:
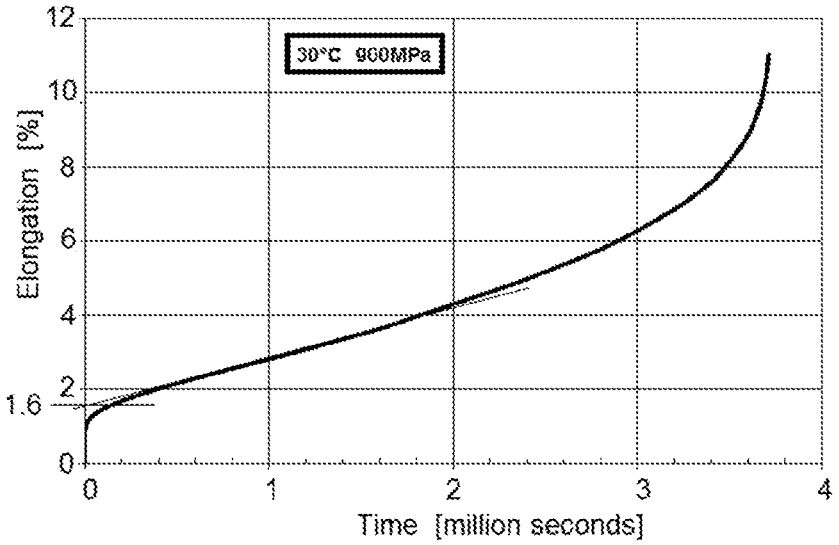
FIG. 16 is a plot of the creep behavior (Elongation [%] of the fiber versus Time [seconds] of the fiber used to determine stabilizing creep in accordance with the Examples hereinbelow.

The stabilizing creep was determined by plotting the creep behavior (Elongation [%] of the fiber versus Time [seconds] of said fiber as shown in FIG. 16), at a tension of 900 MPa and a temperature of 30° C. and as mentioned in the "tensile properties of the fiber" herein above. A tangent line is constructed on the creep curve in FIG. 16, at the location where the creep rate is minimum (i.e. where the slope of the tangent line is minimum). The intersection point of this tangent with the vertical axis (Elongation [%]) provides a first amount value of the stabilized creep in the fiber. The stabilizing creep is calculated as the value at this intersection point minus the value of the elastic strain (%). The elastic strain is typically the initial elongation distance (unit of length, e.g. mm) divided by the original length of the elongated fiber. The elastic strain may either be measured (e.g. from displacement of grips, preferably measuring the displacement between markings on the fiber) directly after reaching the creep load, e.g. after few seconds after reaching the creep load or alternatively it may be calculated by dividing the applied stress (measured as MPa) on the fiber, e.g. yarn by the tensile modulus (measured in same unit as the stress).

Example 1A

Three polymeric yarns comprising commercially available fibers from DSM under the trade name Dyneema® DM20, having a titer of 1760 dtex, a twist rate of 40 turns per meter, a 32 cN/dtex initial specific yarn strength and a minimum creep rate of $1.3\times10^{-6}$% per second measured at a tension of 900 MPa and a temperature of 30° C. were used, the yarns being approximately equal in length (each of a nominal length of about 50 cm). All three yarns were situated in parallel position and fixated at the ends, forming a statically over-determined structure. Said yarns were tested to fracture (the force at break) according to the method as described herein. The results are shown in Table 1.

In FIG. 16, the elastic strain for the yarn sample of Example 1A is about 0.8%, which means that the stabilizing creep amount is about 1.6% minus about 0.8%, and resulting in about 0.8%. The intersection point of the tangent (i.e. at the location where the creep rate is minimum, i.e. where the slope of the tangent line is minimum) with the vertical axis (elongation [%]) provides a first amount value of the stabilized creep in the fiber, i.e. about 1.6% in FIG. 16.

Figure 17:
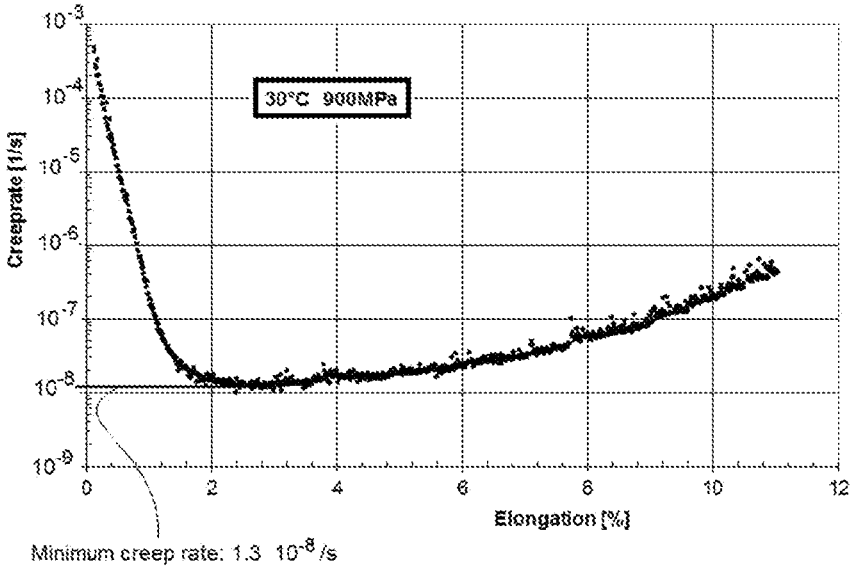
FIG. 17 is a Sherby and Dorn plot of the results presented in the plot of FIG. 16.

The diagram of FIG. 16 can also be presented as a so called Sherby and Dorn plot. This is shown in FIG. 17 that illustrates the Sherby and Dorn plot of the results presented in FIG. 16. FIG. 17 shows that the creep rate of creep stabilized fibers of Example 1A may decrease over almost 5 decades, behavior that is typical for creep stabilized fibers. In FIG. 17, the minimum creep rate of the yarn sample of Example 1A is about $1.3\times10^{-8}$ per second (or $1.3\times10^{-6}$% per second); this is an average value.

The results are shown in Table 1.

Example 1B

Example 1B was performed by repeating Example 1A, with the difference that one of said three yarns (e.g. situated in between the two longer yarns) was 1.5% shorter than the other two yarns that were approximately equal in length. The results are shown in Table 1.

Example 1C

Example 1C was performed by repeating Example 1 B, with the difference that all yarns were first loaded for 2 weeks' time at a load of 60% of the initial load value (as applied in Example 1B). The results are shown in Table 1 and Table 2.

Comparative Experiment 1A

Comparative Experiment 1A was performed by repeating Example 1A, with the difference that the three polymeric yarns were commercially available under the trade name Dyneema® SK75 having a titer of 1760 dtex, a twist rate of 40 turns per meter, a 35 cN/dtex initial specific yarn strength and a minimum creep rate of $2.4\times10^{-5}$% per second measured at a tension of 900 MPa and a temperature of 30° C. The results are shown in Table 1.

Comparative Experiment 1B

Comparative Experiment 1B was performed by repeating Comparative Experiment 1A, with the difference that one of said three yarns was 1.5% shorter than the other two yarns that were approximately equal in length. The results are shown in Table 1.

Comparative Experiment 1C

Comparative Experiment 1C was performed as intended by repeating Comparative Experiment 1B, with the difference that the yarns were loaded for 2 weeks' time at a load of 60% of the load value applied in Comparative Experiment 1 B. However, an excessive strain of 15% was already reached after 8.7 days. Such a large strain makes a structure useless in any application and therefore the experiment was stopped. No results were thus shown in Table 1 (not applicable).

Comparative Experiment 2A

Comparative Experiment 2A was performed by repeating Example 1A, with the difference that the three polymeric yarns were commercially available under the trade name Twaron®, having a titer of 3220 dtex and a 22 cN/dtex initial specific yarn strength and having a stabilizing creep value very close to zero (not measurable anymore) at very low strain already, measured at a tension of 900 MPa and a temperature of 30° C. The results are shown in Table 1. Another type of Twaron® (with different characteristics and/or composition) is expected to give comparable or worse results in terms of fracture at break and load distribution.

Comparative Experiment 2B

Comparative Experiment 2B was performed by repeating Comparative Experiment 2A, with the difference that one of said three yarns was 1.5% shorter than the other two yarns that were about equal in length. The results are shown in Table 1.

Comparative Experiment 2C

Comparative Experiment 2C was performed by repeating Comparative Experiment 2B, with the difference that the yarns were loaded for 2 weeks' time at a load of 60% of the load value applied in Comparative Experiment 2B. The results are shown in Table 1 and Table 2.

TABLE 1

| Sample | Force at break [N] |
|---|---|
| Example 1A | 1186 |
| Example 1B | 877 |
| Example 1C | 1060 |
| Comparative Experiment 1A | 1263 |
| Comparative Experiment 1B | 895 |
| Comparative Experiment 1C | not applicable |
| Comparative Experiment 2A | 1197 |
| Comparative Experiment 2B | 711 |
| Comparative Experiment 2C | 860 |

The results shown in Table 1 demonstrate that the lowest strength reduction occurred for the structures of Examples 1B in comparison with Comparative Experiments 1B and 2B. The data in Table 1 clearly shows that two weeks of loading causes a strength recovery. The strength recovery of the test according to the invention with creep stabilizing fibers (Examples 1C) is larger than the strength recovery observed for the comparative experiments (Comparative Experiment 2C). In fact, the structure according to the invention almost reached the theoretical maximum strength value (Example 1C), whereas the recovery of the Comparative Experiments 2C was lower and still 30% of the theoretical maximum strength was lost. Also, the creep of the structures of Comparative Experiments 1 A-C and 2A-C was not stabilized. 3% strain was measured for the structure of Example 1C (which is acceptable for structures), 15% strain was measured for the structure of Comparative Experiment 1C already after 8.7 days under load, which is non-acceptable for structures, thus the test was immediately stopped. The structure of Comparative Experiment 2C hardly showed hardly any creep behavior (0.25% strain), but a serious strength reduction due to length differences and only very limited recovery of the strength reduction. Consequently, it is demonstrated that the structures according to the present invention show improved safety during the majority of their life time.

TABLE 2

| | Short yarn | One of the longer yarns | Load difference |
|---|---|---|---|
| Example 1C | | | |
| Initial load applied, N | 242 | 141.5 | 100.5 |
| Load measured after 2 weeks, N | 187.8 | 168.6 | 19.2 |
| The load difference after 2 weeks, % | — | — | 19.1% |
| Comparative Experiment 2C | | | |
| Initial load applied, N | 300 | 112.4 | 187.6 |
| Load measured after 2 weeks, N | 292.5 | 116.3 | 176.2 |
| The load difference after 2 weeks, % | — | — | 93.9% |

Table 2 shows that the load distribution of the fiber according to the present invention (structure of Example 1C) is almost equal after some time, whereas the load distribution of the Twaron® fibers (structure of Comparative Experiment 3C) remains almost as unequal as it was at the start of the experiment. Table 2 shows that 19.1% load inequality remained after two weeks (81.9% of the load has been shared) weeks for the structures according to the present invention, compared to 93.9% load inequality remained after two weeks (only 6.1% of the load has been shared) for the reference structures comprising Twaron®, at the same conditions. Accordingly, in contrast with the structures according to the present invention, the structures made according to the Comparative Experiment 3C lead to premature failure of the more heavily-loaded elements.

The invention claimed is:

1. A structure comprising rigid elements connected together by interconnecting elements in such a way to form a statically determined structure or a statically over-determined structure, wherein the structure comprises at least one tension element comprising polymeric fibers having a stabilizing creep of at least 0.3% and at most 10% and a minimum creep rate lower than $1\times10^{-5}$% per second, wherein the stabilizing creep and the minimum creep rate are measured at a tension of 900 MPa and a temperature of 30° C.

2. The structure according to claim 1, wherein the at least one tension element comprises polymeric fibers having a stabilizing creep of at least 0.5% and at most 5%, as measured at a tension of 900 MPa and a temperature of 30° C.

3. The structure according to claim 1, wherein said at least one tension element comprises polymeric fibers having a minimum creep rate lower than about $4\times10^{-6}$% per second as measured at a tension of 900 MPa and a temperature of 30° C.

4. The structure according to claim 1, wherein the structure is a 2D structure or a 3D structure.

5. The structure according to claim 1, wherein the structure is selected from the group consisting of framing structures, suspended bodies, platforms, and spoked wheels.

6. The structure according to claim 1, wherein the structure is a marine platform comprising up to three tension elements comprising no creep stabilizing fibers and at least one tension element comprising creep stabilizing fibers.

7. The structure according to claim 6, wherein the marine platform is an offshore tension leg platform.

8. The structure according to claim 1, wherein the structure is a marine platform comprising a total of four tension elements, wherein up to three of the tension elements comprise no creep stabilizing fibers and at least one of the tension elements comprise creep stabilizing fibers.

9. The structure according to claim 1, wherein the at least one tension element comprises creep stabilizing polyolefin fibers.

10. The structure according to claim 9, wherein the at least one tension element comprises creep stabilizing polyethylene fibers.

11. The structure according to claim 10, wherein the at least one tension element comprises creep stabilizing ultrahigh molecular weight polyethylene fibers.

12. The structure according to claim 1, wherein the at least one tension element comprises creep stabilizing fibers comprised of ultrahigh molecular weight polyethylene comprising olefinic branches or chlorinated ultrahigh molecular weight polyethylene.

13. The structure according to claim 1, wherein the at least one tension element comprises creep stabilizing fibers comprised of ultrahigh molecular weight polyethylene comprising alkyl branches.

14. The structure according to claim 13, wherein the alkyl branches of the ultrahigh molecular weight polyethylene are ethyl or butyl branches.

15. The structure according to claim 1, wherein the at least one tension element comprises polymeric fibers having a minimum creep rate lower than about $2\times10^{-6}$% per second as measured at a tension of 900 MPa and a temperature of 30° C.

* * * * *